US007112111B1

(12) United States Patent
King

(10) Patent No.: US 7,112,111 B1
(45) Date of Patent: Sep. 26, 2006

(54) CLOSED LOOP BUOYANCY SYSTEM

(75) Inventor: David King, Encinitas, CA (US)

(73) Assignee: David Cameron King, Nevada City, CA (US)

( * ) Notice: Subject to any disclaimer, the term of this patent is extended or adjusted under 35 U.S.C. 154(b) by 0 days.

(21) Appl. No.: 11/318,002

(22) Filed: Dec. 22, 2005

(51) Int. Cl.
*B63B 22/20* (2006.01)

(52) U.S. Cl. ..... 441/29; 441/2; 114/331

(58) Field of Classification Search ..... 441/2, 441/21, 28, 29; 114/331, 333
See application file for complete search history.

(56) References Cited

U.S. PATENT DOCUMENTS 4,266,500 A * 5/1981 Jurca ..... 114/333
4,455,782 A * 6/1984 Seefluth ..... 446/155
4,692,906 A * 9/1987 Neeley ..... 367/15
5,129,348 A * 7/1992 Rannenberg et al. ..... 114/333
5,379,267 A * 1/1995 Sparks et al. ..... 367/18
5,460,556 A * 10/1995 Logan et al. ..... 441/2
6,021,731 A * 2/2000 French et al. ..... 114/331
6,702,989 B1 * 3/2004 Sacks et al. ..... 422/89

* cited by examiner

*Primary Examiner*—Stephen Avila

(57) ABSTRACT

A closed loop buoyancy system wherein a device housing the system is submerged in a liquid filled container, the device dives to the bottom of the container, remains for a regulated amount of time, and then floats back to the surface of the liquid.

14 Claims, 3 Drawing Sheets

CLOSED LOOP BUOYANCY SYSTEM

FIELD OF THE INVENTION

This invention relates to the field of buoyancy systems, more specifically to a device that submerges in liquid, dives to the bottom and subsequently rises to the surface after an adjustable amount of time has elapsed.

BACKGROUND OF THE INVENTION

For over 400 years Cartesian divers have been used to illustrate to students the physical principles of density and buoyancy. Classic Cartesian divers are named for the French scientist Rene Descartes. In a classic Cartesian diver, an external gas chamber is filled with liquid. In classroom experiments this is typically done in a 1.5 liter plastic soda bottle. The squeezing of the bottle then exerts pressure on the liquid. Inside the container is housed a smaller container, i.e. the "diver." The diver has air trapped inside of it. With pressure exerted on the external liquid in the outer container, the squeezed liquid does not compress, but the air trapped inside the diver does. With the change in volume of trapped air, the diver then rises or sinks relative to the pressure of the outer liquid.

An object is buoyant in water due to the amount of water is displaces or "pushes aside." If the weight of the water that is displaced by an object in water exceeds the weight of the object, then the object will float. As pressure is applied to the outer liquid, pressure is also applied to the air pocket trapped inside the diver, thereby reducing the size of the air pocket. As the bubble size reduces, the driver becomes less buoyant and begins to sink. As the pressure is released, the air bubble grows and becomes more buoyant, causing the diver to rise back to the top of the liquid.

A submarine uses this principal in a slightly different way. The submarine contains ballast tanks that can be filled or emptied of air. The air that moves to and from these tanks is at the current pressure of the water outside of the submarine. A submerged submarine that is at a steady state, neither rising nor sinking, will rise when air is introduced into the ballast tank or sink when air is removed from the ballast tank because this movement of air causes changes in the submarine's buoyancy.

The prior art involving the use of these physical principles utilize an outside container that absorbs the pressure change, thereby effectuating the falling and rising of the diver. A Cartesian toy that allows the floating diver to move in a horizontal direction as well as the classic vertical direction is disclosed by Seefluth in U.S. Pat. No. 4,455,782, but this invention is limited to the exertion of pressure upon the outside liquid container itself. This limits the usefulness of the diving device outside of the context of closed, relatively small liquid containers. Currently, there is nothing on the market that allows an object to dive in a large body of water, such as a bathtub, swimming pool, pond or lake that will then wait for a period of time before resurfacing. Therefore, a need exists for such a system.

SUMMARY OF THE INVENTION

In the preferred embodiment of the invention, a system is defined that allows an object housing the instant invention to dive under water, sit submerged for an adjustable amount of time, and then resurface. The invention consists of two identical rubber chambers. One chamber is the buoyancy chamber and the other is the pressure chamber. The two chambers abut each other and are connected through two PVC cap ends that are screwed together through an NPT to a ¼" plastic hose adapter. The plastic hose adapter extends into the cap end in the direction of the pressure chamber. Inside the pressure chamber is a ballast.

A t-type fitting and ¼" hose connect a high volume, one-way check valve. This connection allows pressure to enter the pressure chamber very quickly. The other end of the t-type fitting is connected to a small capillary tube and a valve that is almost completely closed. The capillary tube and valve allow for the pressure in the pressure chamber to equalize with the buoyancy chamber at an adjustable, but slow rate. Nipple fittings of various sizes can be used to regulate the flow rate of air back into the buoyancy chamber for longer or shorter submersion times before the object returns to the surface. An electric pump or solenoid valve is used to regulate the flow of air through the capillary tube.

Typically, the buoyancy chamber is squeezed by hand, but pressure can be exerted through the use of an electric pump motor. Once pressure is exerted on the buoyancy chamber, air is forced into the pressure chamber through the high volume one-way check valve. The object housing the device, or just the device itself, is then dropped into a large body of water, such as a swimming pool, bathtub, pond or lake. The object sinks to the bottom of the body of water. It stays down until the higher pressure in the pressure chamber equalizes and the buoyancy chamber regains its buoyancy. Once buoyancy is re-established, the device will then start to float back up to the surface. Through variations of nipple sizes, this can take anywhere from several seconds to several minutes.

The physics of the system is simple to understand to those in the art. Depending upon the size and upon the mechanics of squeeze on the device's buoyancy chamber, it will always be known what the maximum depth to which the device can descend without becoming stuck at the bottom due to external water pressure surpassing that of the air displaced from the buoyancy chamber into the pressure chamber. One can use the following formula, remembering that it is dependent upon the fluid's density. Accordingly, sea water, lake water and pool water will all have different critical depths.

$$P_{\text{static fluid}} = \rho g h$$

where $\rho = m/V$ = fluid density $g$ = acceleration of gravity $h$ = depth of fluid A buoyancy system that allows an object to be tossed in a large body of water and then resurface at a later time has countless applications. The invention could be used for bathtub toys, pool toys, remote control toys, ballasted submarines, underwater racers and underwater night time light shows. Adventure figure dolls used by children could truly dive with a strap-on device. The system can also be scaled up for real world applications, such as ROVs.

In its smaller version, the device can be safely used as a bathtub toy that would dive, hold, and then float. In pools it can by used by older children as well as adults and can be housed by various shaped objects, the types of which are virtually limitless. The device can be used to keep a remote controlled toy at the bottom, while racing, exploring, or rescuing something "lost at sea." In almost the exact same manner as garden lighting, the device can be told to sink to the bottom of the pool at night and put on an LED light show. When power runs low on the light show, the unit resurfaces and waits for the sun to come up and recharge its batteries via its solar cells.

OBJECT OF THE INVENTION

The principal object of the invention is to allow an object housing the instant invention to dive under water, sit submerged for an adjustable amount of time, and then resurface.

DETAILED DESCRIPTION OF AN ENABLING AND PREFERRED EMBODIMENT

Figure 1:
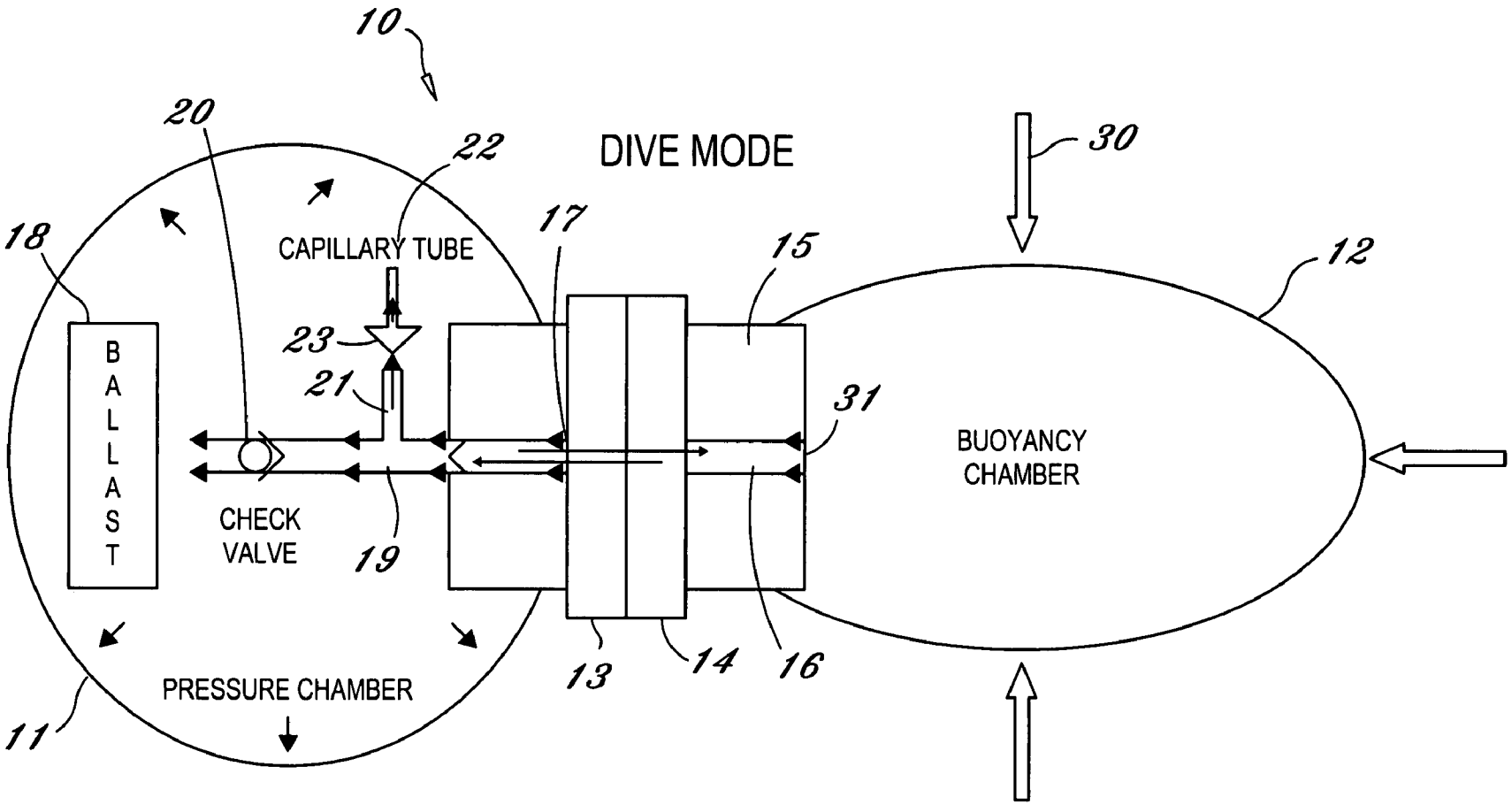
FIG. 1 illustrates the invention after the application of pressure, the system being in dive mode.
Figure 2:
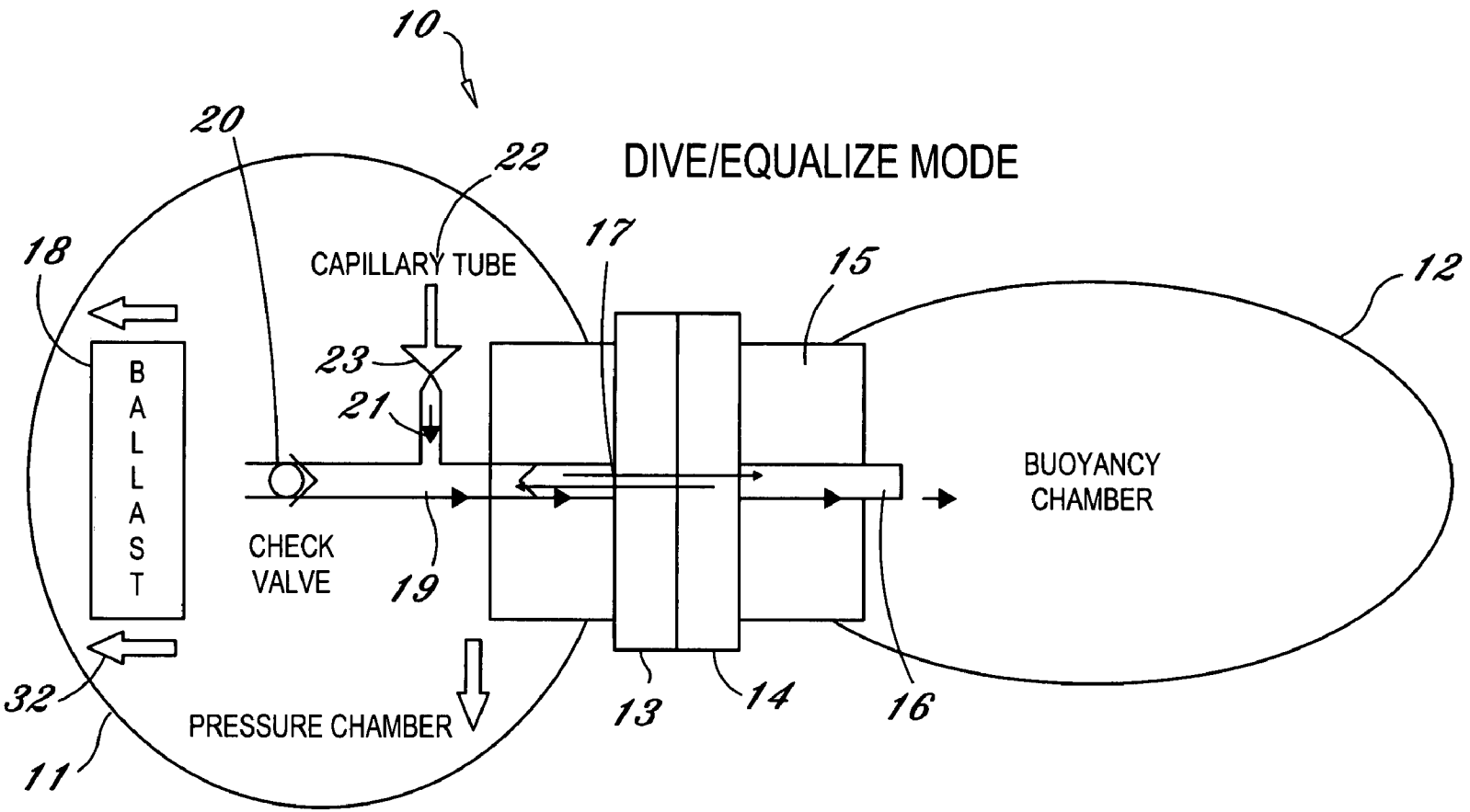
FIG. 2 illustrates the invention as it begins to equalize the pressure, the system being in dive/equalize mode.
Figure 3:
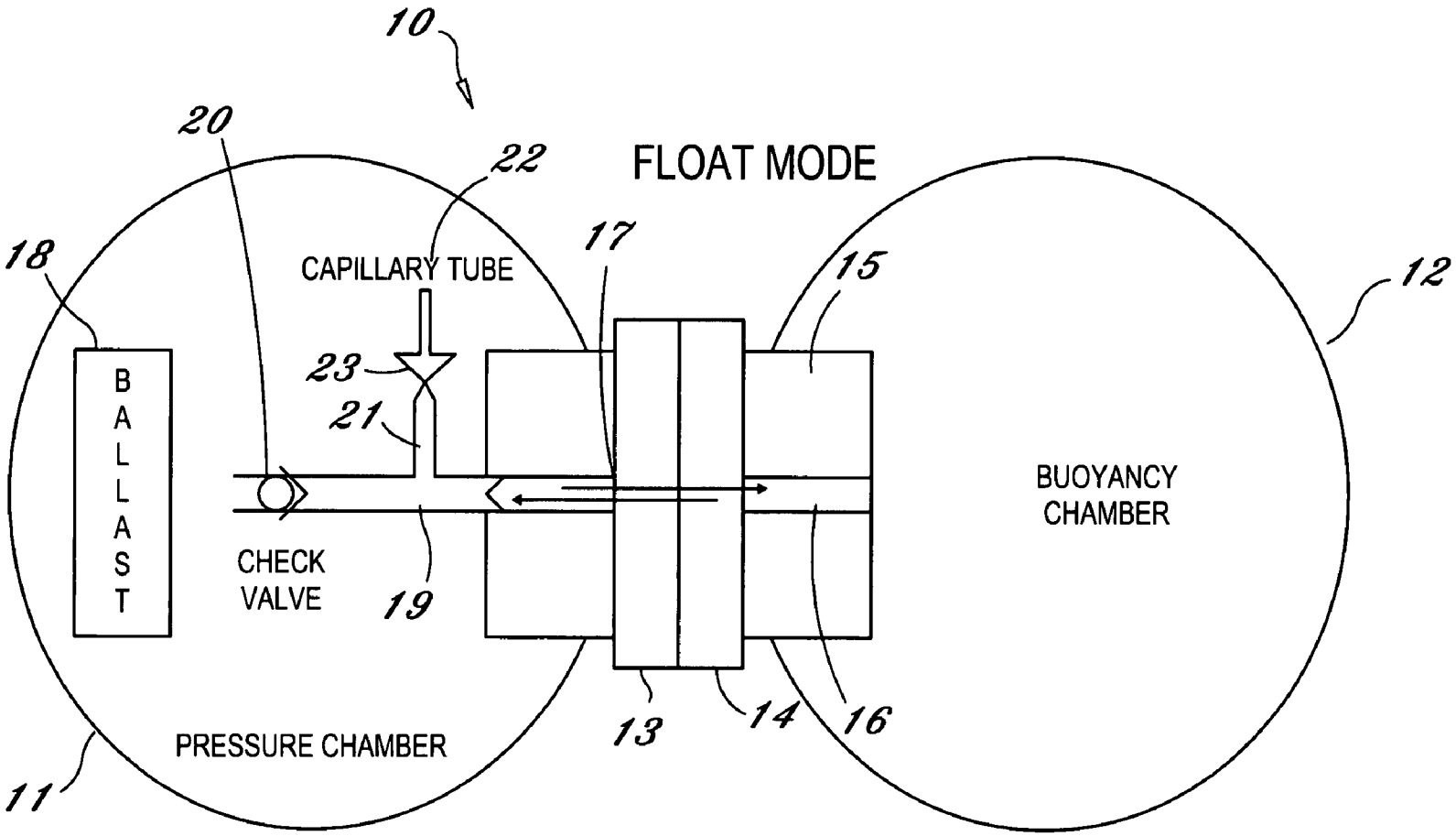
FIG. 3 illustrates the invention after the pressure has equalized, the system being in float mode.

For a better understanding of the invention, turn now to the drawings, FIGS. 1–3 illustrate the invention in various modes, generally designated by reference character 10. FIG. 3 shows the invention at rest and in float mode. The invention includes two rubber chambers 11, 12, one chamber designated as the buoyancy chamber 12 and other as the pressure chamber 11. The two chambers 11, 12 abut one another and are connected through two PVC cap ends 13, 14 that are screwed together through an NPT 15 to a ¼" plastic hose adapter 16. The plastic hose adapter 16 extends into the cap end 17 in the direction of the pressure chamber 11. Inside the pressure chamber 11 is a ballast 18.

A t-type fitting 19 and ¼" hose 16 connect a high volume, one-way check valve 20. This connection allows pressure to enter the pressure chamber 11 very quickly. The other end 21 of the t-type fitting 19 is connected to a small capillary tube 22 and a valve 23 that is almost completely closed. The capillary tube 22 and valve 23 allow for the pressure in the pressure chamber 11 to equalize with the buoyancy chamber 12 at an adjustable, but slow rate. Nipple fittings of various sizes (not shown) can be used to regulate the flow rate of air back into the buoyancy chamber 12 for longer or shorter submersion times before the object returns to the surface. An electric pump or solenoid valve regulates the flow of air through the capillary tube 22.

Pressure 30 is exerted on the buoyancy chamber 12, as illustrated in FIG. 1, forcing air 31 into the pressure chamber 11 through the high volume one-way check valve 20. The object housing the device, or just the device itself, is then dropped into a large body of water, such as a swimming pool, bathtub, pond or lake. The object sinks to the bottom of the body of water. It stays down until the higher pressure in the pressure chamber 11 equalizes and the buoyancy chamber 12 regains its buoyancy as illustrated in FIG. 2.

Pressurized air 32 slowly enters the capillary tube 22, which is regulated through a variable sized valve 23, and then returns, through the t-type fitting 19 and ¼" hose 16, into the buoyancy chamber 12. Once buoyancy is re-established, the device takes the form illustrated in FIG. 3 and starts to float to the surface. Through variation of nipple size (not shown) on the valve 23 connected to the capillary tube 22, this can take anywhere from several seconds to several minutes.

The illustrations and examples provided herein are for explanatory purposes and are not intended to limit the scope of the appended claims, as those skilled in the art will make modifications to the invention for particular uses.

I claim:

1. A closed loop buoyancy system comprising
- two identical chambers, one of said chambers identified as a buoyancy chamber and the other identified as a pressure chamber;
- means for connecting said chambers so that said chambers abut one another, said connecting means containing a portion that extends into said pressure chamber;
- a t-shaped fitting attached to said connecting means and extending into said pressure chamber;
- a high volume, one-way check valve positioned on one end of said t-shaped fitting;
- a small capillary tube positioned on the other end of said t-shaped fitting;
- a valve positioned between said capillary tube and said t-shaped fitting;
- an electric pump or solenoid valve regulating the flow of air through said capillary tube;
- a ballast; and
- means for exerting pressure on said buoyancy chamber effecting a pressure increase on said pressure chamber.

2. A closed loop buoyancy system according to claim 1 wherein said buoyancy chamber is composed of a flexible and durable material, such as rubber, than can expand and contract without undue wear.

3. A closed loop buoyancy system according to claim 1 wherein said connecting means is comprised of two cap ends that are screwed together using a fitting and a plastic hose adapter.

4. A closed loop buoyancy system according to claim 1 wherein said means for exerting pressure is effected through the manual squeezing of said buoyancy chamber by the hand of the user.

5. A closed loop buoyancy system according to claim 1 wherein said means of exerting pressure is effected through the use of a battery powered motor.

6. A closed loop buoyancy system according to claim 1 wherein said valve positioned on said capillary tube is modifiable through the use of varying size nipple attachments regulating the flow of air through said capillary tube.

7. A closed loop buoyancy system according to claim 1 wherein said ballast is housed in said pressure chamber.

8. A method for modulating buoyancy comprising
- application of pressure to one of two identical chambers, said chamber identified as the buoyancy chamber in a closed loop buoyancy system comprising
  - two identical chambers, one of said chambers identified as a buoyancy chamber and the other identified as a pressure chamber;
  - means for connecting said chambers so that said chambers abut one another, said connecting means containing a portion that extends into said pressure chamber;
  - a t-shaped fitting attached to said connecting means and extending into said pressure chamber;
  - a high volume, one-way check valve positioned on one end of said t-shaped fitting;
  - a small capillary tube positioned on the other end of said t-shaped fitting;
  - a valve positioned between said capillary tube and said t-shaped fitting;

an electric pump or solenoid valve regulating the flow of air through said capillary tube; and a ballast submersion of said device into a volume of water larger than the volume of the device.

9. A buoyancy modulating method according to claim 8 wherein said chambers are composed of a flexible and durable material, such as rubber, that can expand and contract without undue wear.

10. A buoyancy modulating method according to claim 8 wherein said connecting means is comprised of two cap ends that are screwed together using a fitting and a plastic hose adapter.

11. A buoyancy modulating method according to claim 8 wherein said means for exerting pressure is effected through the manual squeezing of said buoyancy chamber by the hand of the user.

12. A buoyancy modulating system according to claim 8 wherein said means of exerting pressure is effected through the use of a battery powered motor.

13. A buoyancy modulating system according to claim 8 wherein said valve positioned on said capillary tube is modifiable through the use of varying size nipple attachments regulating the flow of air through said capillary tube.

14. A buoyancy modulating system according to claim 8 wherein said ballast is housed in said pressure chamber.

* * * * *